US007100513B2

(12) United States Patent
Gerardi

(10) Patent No.: US 7,100,513 B2
(45) Date of Patent: Sep. 5, 2006

(54) PROGRAMMABLE PYROTECHNIC PROJECTILE AND METHODS FOR PRODUCING FIREWORK PATTERNS THEREWITH

(76) Inventor: Michael M. Gerardi, 28876 Woodcrest Lake Dr., Menifee, CA (US) 92584

( * ) Notice: Subject to any disclaimer, the term of this patent is extended or adjusted under 35 U.S.C. 154(b) by 50 days.

(21) Appl. No.: 10/825,956

(22) Filed: Apr. 16, 2004

(65) Prior Publication Data

US 2005/0217526 A1 Oct. 6, 2005

Related U.S. Application Data

(60) Provisional application No. 60/463,604, filed on Apr. 17, 2003.

(51) Int. Cl.
*F42B 4/24* (2006.01)

(52) U.S. Cl. ..... 102/360; 102/345; 102/489

(58) Field of Classification Search ..... 102/360, 102/345, 489, 438
See application file for complete search history.

(56) References Cited

U.S. PATENT DOCUMENTS 6,626,078 B1 * 9/2003 Thornton ..... 89/1.13
2004/0107861 A1 * 6/2004 Nardone et al. ..... 102/489

FOREIGN PATENT DOCUMENTS

GB 2382332 A * 5/2003

* cited by examiner

*Primary Examiner*—Troy Chambers

(57) ABSTRACT

A pyrotechnic projectile includes a body, projectile GPS means for determining the position of the pyrotechnic projectile, a plurality of pyrotechnic sub-units disposed within the body, and ejection means responsive to the projectile GPS means. The pyrotechnic sub-units include sub-unit GPS means for determining the position of the sub-unit, and ignition means for igniting the sub-unit when the position determined by the sub-unit GPS means corresponds to a pre-selected position. The ejection means eject the plurality of sub-units from the body.

4 Claims, 1 Drawing Sheet

PROGRAMMABLE PYROTECHNIC PROJECTILE AND METHODS FOR PRODUCING FIREWORK PATTERNS THEREWITH

This application is based on Provisional U.S. Patent Application Ser. No. 60/463,604, filed Apr. 17, 2003, the entire disclosure of which is incorporated herein by reference.

FIELD OF THE INVENTION

The present invention relates to fireworks products in general, more particularly to aerial fireworks products. Specifically, the present invention relates to pyrotechnic projectiles for producing firework patterns in the sky, and to methods for producing firework patterns using such projectiles.

BACKGROUND OF THE INVENTION

Aerial fireworks products, such as skyrockets, bombs and the like have been known for centuries. Bombs, or mortars, typically are launched from upright launch tubes by detonation of a concussion charge or other propulsion means. Once the bomb reaches its desired elevation (determined by an internal fuse or other means), the bomb explodes and disperses a plurality of stars stored within the body of the bomb. These stars, which are formed from a pyrotechnic composition that bums with a characteristic color, depending on the chemical formulation of the pyrotechnic composition, ignite and are dispersed in the atmosphere to form a firework pattern.

Firework patterns produced by bombs are typically spherically symmetric, but can also have other geometries. Planar shapes, including circles, as well as asymmetric shapes, can be produced by various means. For example, U.S. Pat. No. 6,324,981 discloses a pyrotechnic projectile including a body which contains a bursting charge and a combustible charge. The combustible charge is dispersed within the bursting charge in a pattern that corresponds to the shape of the firework pattern that is to be obtained in the sky.

Known pyrotechnic projectiles, however, are limited in the precision with which the firework pattern obtained in the sky can be controlled. Moreover, known projectiles are constrained to produce a single firework pattern, which is controlled by the disposition pattern of the stars or other combustible materials within the both of the projectiles.

Furthermore, known pyrotechnic projectiles do not afford control of the firework pattern subsequent to ignition of the stars. That is, once the stars ignite, they follow a generally ballistic flight path from their respective points of ignition.

A need exists for a pyrotechnic projectile which affords precise control of a firework pattern obtained in the sky by use of the projectile. In particular, a need exists for a pyrotechnic projectile that can be programmed to produce a variety of firework patterns, whether symmetric or asymmetric, without the need for changing the disposition of stars or other combustible materials within the body of the projectile.

A need also exists for a pyrotechnic projectile that enables production of an animated firework pattern, that is, a firework pattern that changes in a controlled way even after ignition commences.

A need also exists for a method of producing firework patterns using such improved pyrotechnic projectiles.

SUMMARY OF THE PREFERRED EMBODIMENTS

In accordance with one aspect of the present invention, there is provided a pyrotechnic projectile that includes a body, projectile GPS means for determining the position of the pyrotechnic projectile, a plurality of pyrotechnic sub-units disposed within the body, and ejection means responsive to the projectile GPS means. The pyrotechnic sub-units include sub-unit GPS means for determining the position of the sub-unit, and ignition means for igniting the sub-unit when the position determined by the sub-unit GPS means corresponds to a pre-selected position. The ejection means eject the plurality of sub-units from the body.

According to a particular embodiment, at least one of the pyrotechnic sub-units further includes maneuvering means for altering the velocity of the pyrotechnic sub-unit.

In accordance with another aspect of the present invention, there is provided a method of producing a firework pattern in the sky that includes the steps of: selecting a plurality of GPS coordinates that together form a pattern; launching a pyrotechnic projectile as described herein; ejecting the plurality of pyrotechnic sub-units from the body of the pyrotechnic projectile; and igniting each of the pyrotechnic sub-units when the position of the pyrotechnic sub-unit corresponds to the GPS coordinate associated with the pyrotechnic sub-unit.

In accordance with a further aspect of the present invention, there is provided a method of producing an animated firework pattern in the sky that includes the steps of: selecting a plurality of GPS coordinates that together form a pattern and a plurality of flight paths originating each originating at one of the plurality of GPS coordinates; launching a pyrotechnic projectile as described herein, the projectile including maneuvering means for altering the velocity of the pyrotechnic sub-unit; ejecting the plurality of pyrotechnic sub-units from the body of the pyrotechnic projectile; igniting each of the pyrotechnic sub-units when the position of the pyrotechnic sub-unit corresponds to the GPS coordinate associated with the pyrotechnic sub-unit; and maneuvering each of the pyrotechnic sub-units along the flight path originating from the GPS coordinate associated with the pyrotechnic sub-unit.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

"GPS means" denotes any device capable of determining the location of an object using the Global Positioning System.

Figure 1A:
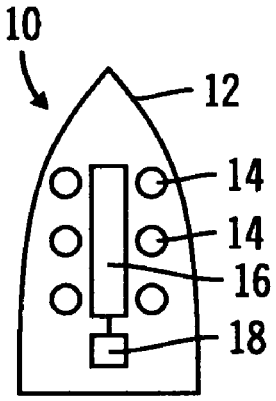
FIGS. 1A–B are side- and cross-sectional schematic illustrations of an embodiment of a pyrotechnic projectile according to the invention, including a plurality of pyrotechnic sub-units.
Figure 1B:
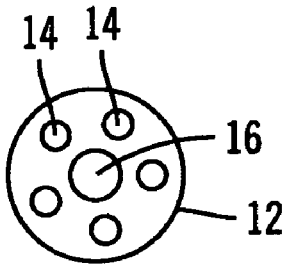
Figure 2:
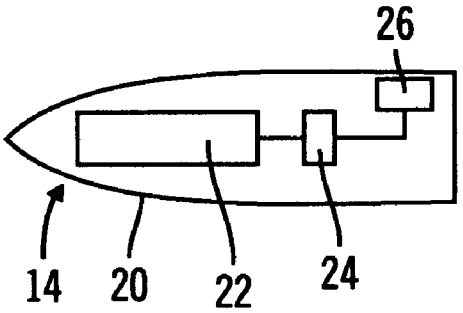
FIG. 2 is a side-sectional schematic illustration of a pyrotechnic sub-unit according to the invention.

FIGS. 1–2 illustrate a first embodiment of a pyrotechnic projectile according to the present invention. Pyrotechnic projectile 10 includes body 12 containing a plurality of pyrotechnic sub-units 14, ejection means 16, and GPS means 18.

In certain specific embodiments, body 12 is formed in a conventional manner, and the pyrotechnic sub-units 14 are packed within body 12 in a manner similar to the packing of stars within known bomb bodies. In such embodiments, ejection means 16 is typically a conventional bursting charge together with an ignition device that is responsive to GPS means 18 and ignites the bursting charge in response to a signal provided by GPS means 18.

In other specific embodiments, body 12 and pyrotechnic sub-units 14 are configured in a manner similar to military submunition delivery systems. In such embodiments, body 12 is typically a pod having multiple distinct tubes within which the pyrotechnic sub-units 14 are disposed and from which the sub-units 14 are launched. Ejection means 16 is such embodiments can comprise a plurality of independent launching elements, such as explosive charges, gas generation means (such as sodium azide) or rocket motors, each of the independent launching elements being associated with a separate sub-unit 14. In very specific embodiments, each independent launching element can be configured to eject its associated sub-unit 14 at an independently selected velocity, in a desired sequence and/or upon receipt of an independent signal from GPS means 18.

Alternatively, a single bursting charge can be used to eject all of the sub-units 14 from the body 12 via the tubes in which they are disposed.

Pyrotechnic projectile 10 can include, in additional particular embodiments, stabilization elements such as forwardly disposed weights, fins, and the like. Such elements are well know to those skilled in the art.

Ejection means 16 of pyrotechnic projection 10 eject the individual pyrotechnic sub-units 14 upon receipt of at least one signal from GPS means 18. In particular embodiments, ejection of the sub-units 14 occurs simultaneously when GPS means 18 reaches a predetermined GPS coordinate and provides ejection means 16 with a signal to commence ejection of the sub-units at that GPS coordinate. In other particular embodiments, some or all of the sub-units 14 are independently ejected at two or more GPS locations. In such embodiments, GPS means 18 separately provides signals to ejection means 16 associated with each sub-unit 14 or group of sub-units 14 when it determines that the appropriate GPS coordinate for ejection of such sub-unit or group of sub-units has been reached. Ejection means 16 can include a programmable element, such as a microprocessor, which enables specification of the GPS coordinate or coordinates at which ejection is to occur. Alternatively, a separate programmable element can be provided which is in communication with ejection means 16 and with GPS means 18.

An exemplary pyrotechnic sub-unit is schematically illustrated in FIG. 2. Sub-unit 14 includes body 20 which contains pyrotechnic material 22, ignition means 24, and sub-unit GPS means 26. Ignition means 24 is responsive to sub-unit GPS means 26 and ignites pyrotechnic material 22 in response to a signal provided by sub-unit GPS means 26.

Each pyrotechnic sub-unit 14 is independently programmable such that ignition means 24 ignites pyrotechnic material 22 when a desired location is reached. For example, each of the pyrotechnic sub-units 14 can be programmed for ignition when it has reached a specified distance from the GPS coordinate at which it was ejected from the pyrotechnic projectile 10. Alternatively, the sub-units 14 can be programmed for ignition when they have reached independently pre-selected GPS locations. Position tolerances can also be pre-selected in more specific embodiments. For example, ignition can be specified when the pyrotechnic sub-unit 14 has traveled a distance of 500 feet +/−10 feet, or has arrived within 10 feet of a specified GPS coordinate.

As with the pyrotechnic projection itself, the pyrotechnic sub-units, in particular embodiments, utilize ignition means 24 which include a programmable element, such as a microprocessor. In alternative embodiments, a programmable element is provided separately from ignition means 24 and in communication with ignition means 24 and with sub-unit GPS means 26.

In additional very specific embodiments, pyrotechnic projectile 10 and/or pyrotechnic sub-units 14 can have a modular construction in which respective GPS means 18 and 26 are detachable from respective bodies 12 and 20, in order to facilitate recovery and reuse of the GPS means.

In use, pyrotechnic projectile 10 is launched, in any desired manner known to those skilled in the art. Upon reaching the GPS coordinate or coordinates selected for ejection of the pyrotechnic sub-units 14, the sub-units are ejected from projectile 10. Each sub-unit subsequently ignites at its selected GPS coordinate to produce a desired firework pattern in the sky. Such patterns can be highly non-symmetric as well as spherically or radially symmetric if desired Different pyrotechnic materials affording a variety of colors can be used in different sub-units, as is well-known in the art.

In many applications, the sub-unit ignitions will not be simultaneous. This can be exploited to produce a motion effect. In various applications, earlier-ejected sub-units can be constructed to bum longer in order to achieve desired visual effects.

In other applications, simultaneous ignition of the pyrotechnic sub-units is achieved even when the firework pattern is asymmetric. Simultaneous ignition is achieved, in particular embodiments, by independently providing each pyrotechnic sub-unit 14 or group of sub-units 14 with ejection means that vary in ejection velocity. In this way, sub-units 14 that must travel a greater distance prior to ignition travel at a correspondingly greater velocity, such that each of the sub-units 14 reaches its selected ignition GPS coordinate at approximately the same time.

Figure 3:
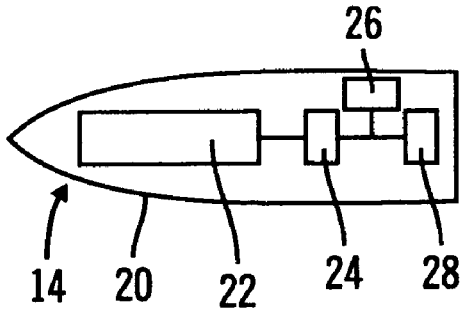
FIG. 3 is a side-sectional schematic illustration of an alternative pyrotechnic sub-unit further including maneuvering means for altering the velocity of the sub-unit.

To further assure that the various sub-units 14 reach their designated GPS coordinates at the desired times (which may or may not be simultaneous), additional particular embodiments of the sub-units 14 are provided with maneuvering means 28 (see FIG. 3) which are in communication with sub-unit GPS means 26. Maneuvering means 26 can include, in specific embodiments, thrusters, steering vanes, fins, air brakes, and the like, and also associated control elements such as microprocessors.

Sub-units 14 equipped with maneuvering means 28 also afford animated firework patterns. In such embodiments, maneuvering means 28 operate subsequent to ignition of pyrotechnic material 22, resulting in non-ballistic movement of the sub-units 14. Appropriate combinations of asymmetric ignitions and post-ignition maneuvers can afford firework patterns that include complex animation effects, such as waving flags, advertising scrolls, flying dragons and the like.

According to other specific embodiments, a plurality of pyrotechnic projectiles 10 can be employed, simultaneously or consecutively, to produce desired firework patterns and/or animated effects.

Additional embodiments further include means for disabling the pyrotechnic projectile when the projectile is being used without authorization, or when the projectile is launched from an unauthorized location (e.g., a GPS coordinate).

In the foregoing description, GPS means have been employed in order to determine the location of the pyrotechnic projectile. Other means for determining the location of the pyrotechnic projection, such as radar, lidar, etc., are also useful and the use thereof is specifically contemplated in alternative embodiments of the invention.

What is claimed is:

1. A pyrotechnic projectile comprising:

a) a body, b) projectile GPS means for determining the position of the pyrotechnic projectile, c) a plurality of pyrotechnic sub-units disposed within the body, each of the sub-units comprising:

i) sub-unit GPS means for determining the position of the sub-unit, and ii) ignition means for igniting the sub-unit when the position determined by the sub-unit GPS means corresponds to a pre-selected position, and d) ejection means responsive to the projectile GPS means for ejecting the plurality of sub-units from the body.

2. The pyrotechnic projectile of claim 1 wherein at least one of the pyrotechnic sub-units further comprises (iii) maneuvering means for altering the velocity of the pyrotechnic sub-unit.

3. A method of producing a firework pattern in the sky that comprises the steps of:

a) selecting a plurality of GPS coordinates that together form a pattern, b) launching a pyrotechnic projectile comprising:

i) a body, ii) projectile GPS means for determining the position of the pyrotechnic projectile, iii) a plurality of pyrotechnic sub-units disposed within the body, each of the sub-units comprising (A) GPS means for determining the position of the pyrotechnic sub-unit, and (B) ignition means for igniting the pyrotechnic sub-unit when the position determined by the GPS means corresponds to one of the plurality of GPS coordinates forming the pattern, the GPS coordinate being associated with the pyrotechnic sub-unit, and iv) ejection means responsive to the projectile GPS means for ejecting the plurality of pyrotechnic sub-units from the body of the pyrotechnic projectile, c) ejecting the plurality of pyrotechnic sub-units from the body of the pyrotechnic projectile, and d) igniting each of the pyrotechnic sub-units when the position of the pyrotechnic sub-unit corresponds to the GPS coordinate associated with the pyrotechnic sub-unit.

4. A method of producing an animated firework pattern in the sky that comprises the steps of:

a) selecting a plurality of GPS coordinates that together form a pattern and a plurality of flight paths each originating at one of the plurality of GPS coordinates, b) launching a pyrotechnic projectile comprising:

i) a body, ii) projectile GPS means for determining the position of the pyrotechnic projectile, iii) a plurality of pyrotechnic sub-units disposed within the body, each of the sub-units comprising (A) GPS means for determining the position of the pyrotechnic sub-unit, (B) ignition means for igniting the pyrotechnic sub-unit when the position determined by the GPS means corresponds to one of the plurality of GPS coordinates forming the pattern, the GPS coordinate being associated with the pyrotechnic sub-unit, and (C) maneuvering means for altering the velocity of the pyrotechnic sub-unit, and iv) ejection means responsive to the projectile GPS means for ejecting the plurality of pyrotechnic sub-units from the body of the pyrotechnic projectile, c) ejecting the plurality of pyrotechnic sub-units from the body of the pyrotechnic projectile, d) igniting each of the pyrotechnic sub-units when the position of the pyrotechnic sub-unit corresponds to the GPS coordinate associated with the pyrotechnic sub-unit, and e) maneuvering each of the pyrotechnic sub-units along the flight path originating from the GPS coordinate associated with the pyrotechnic sub-unit.

* * * * *